12/11/79 XR 4,177,572

United States Patent [19]

Hindes

[11] 4,177,572

[45] Dec. 11, 1979

[54] LIGHTED SIGHT PIN FOR ARCHERY BOWS

[76] Inventor: Ted E. Hindes, 7822 Myers Lake Ave., Rockford, Mich. 49341

[21] Appl. No.: 919,979

[22] Filed: Jun. 28, 1978

[51] Int. Cl.[2] ..... F41G 1/46; F41G 1/34

[52] U.S. Cl. ..... 33/265; 33/241; 350/10

[58] Field of Search ..... 33/245, 246, 241, 265; 124/87; 350/10; 356/247, 251, 252; 362/32, 109, 110, 800

[56] References Cited

U.S. PATENT DOCUMENTS

| | | | |
|---|---|---|---|
| 802,277 | 10/1905 | Fric | 33/241 |
| 1,931,552 | 10/1933 | Maris | 33/241 |
| 2,195,526 | 4/1940 | Traver | 362/32 |
| 2,504,115 | 4/1950 | Dickison | 33/241 |
| 3,284,904 | 11/1966 | Rade | 33/265 |
| 3,582,638 | 6/1971 | Peters | 362/32 |
| 3,678,590 | 7/1972 | Hayward | 33/241 |
| 3,914,873 | 10/1975 | Elliott, Jr. et al. | 33/241 |
| 3,945,127 | 3/1976 | Spencer | 33/241 |

OTHER PUBLICATIONS

Sportronics, "Lighted Sight Bars", 1976, 5 pages.

*Primary Examiner*—Richard R. Stearns

[57] ABSTRACT

A lighted sight pin for archery bows which provides a small point of light for aiming the bow in dim light or at night. The sight pin is structurally protected against damage by brush, tree limbs, etc. and is completely solid state for dependability and long life. A fiber-optic rod transmits light from a light-emitting diode (LED) activated by a voltage source to the sighting end. The light-transmitting rod is surrounded by a rigid shaft or tube. The LED is spaced from the sight end of the rod, allowing the sight end to be extremely small for accurate aiming yet easily visible and fully protected from damage by the rigid shaft or tube and other structure.

18 Claims, 7 Drawing Figures

LIGHTED SIGHT PIN FOR ARCHERY BOWS

BACKGROUND OF THE INVENTION

This invention relates to sighting devices for archery bows and, more particularly, to a lighted sighting device which provides a small point of light for aiming the bow for either hunting or target shooting in all types of light conditions or at night.

Serious hunting or target shooting archers commonly use sophisticated sighting equipment for proper aiming of their archery bows. Of course, when hunting, one of the best periods of the day to find game is during the dimly lighted, early morning or late evening hours and possibly even at night. During such periods, the visibility of even certain sophisticated sights used on archery bows is extremely limited or nonexistent. Accordingly, lighted sights have been devised in an attempt to overcome this problem.

One such lighted, sighting device for use with archery bows is shown in U.S. Pat. No. 3,945,127. This device includes a power source connected to a light source such as a red lens light. Light is transmitted to a series of sighting pins by several exposed optically conductive strands or fibers which extend out of the housing for the power source and curve, unprotected, to connection points with the respective sighting pins. This type of device can be damaged if the optically conductive strands or fibers catch on twigs, branches and other underbrush typically encountered when hunting game using a bow and arrow.

Other lighted sights for archery bows have also been devised. In one, a relatively large light source is secured at the end of a tube or holder. When viewed by the hunter or target shooter, such a sight pin is difficult to use and tends to make proper aiming difficult because of the large size of the light source at the very end of the device which must be used for aiming. Accordingly, accuracy with such prior sighting devices tends to be less than with other prior known, more common, unlighted sighting devices.

In addition to being easily visible and enabling accurate aiming, a sighting device for an archery bow must, therefore, be sufficiently durable, yet affordable by the archer. Because the conditions in which bows and bow sights are used vary greatly, such a sight must be able to withstand all types of weather and yet be sufficiently durable to avoid the necessity for repair especially when one is hunting or shooting in remote locations.

The present invention was conceived and devised in recognition of the above problems. The present sighting device provides a compact, reliable, efficient, lighted bow sight device which allows normal accuracy with the bow in dim light or at night and yet is inexpensive and affordable by the large majority of archers.

SUMMARY OF THE INVENTION

Accordingly, the present invention provides a lighted, sight pin for archery bows which is strong and rigid in construction and protected from damage by brush, tree limbs, accidental striking or the like, provides a highly visible point of light for use in dimly lighted or night conditions, allows high accuracy and proper aiming with the bow, and yet is compact, simple, inexpensive and thus, accessible and obtainable by virtually all archers.

The present sighting device uses a light source to provide light which is transmitted to a small sighting point by means of a light-transmitting cable or rod. The light source is located at a remote position from the sighting point but the light-transmitting cable or rod is completely protected over its entire length by a rigid tube or member. Further, the shielding or protective tube adjacent the sighting point is sufficiently small in size to allow proper aiming and accuracy in shooting while providing sufficient light for proper visibility of the sight end in dim light or at night. The device is extremely reliable and durable because it is completely solid-state in the preferred embodiment.

In one form, the invention is a lighted sight pin for archery bows including a rigid shaft, holding means at one end of the shaft for holding a light source, the shaft and holding means including a continuous passageway extending therethrough. A light source is secured at one end of the passageway at least partially within the holding means and voltage-applying means are connected to the light source to apply electrical voltage thereto. A light-transmitting means extends from the light source, through the passageway and beyond the end of the rigid shaft for transmitting light from the light source to the end of the light-transmitting means to provide a lighted sight at the end of the light-transmitting means. An encapsulating means for covering and protecting the holding means, light source and a portion of the voltage-applying means and shaft are also included.

In other features of the invention, a rigid tube is secured in the passageway at the end of the rigid shaft. The light-transmitting means extend through both the rigid shaft and tube and are coterminous with the tube. The rigid tube is bent at a right angle to the axis of the remainder of the device to provide proper visibility for the sight pin by the archer. The shaft and tube therefore completely protect the entire length of the cable while allowing a sufficiently small sight end on the device to allow accurate shooting.

In yet other features, the light source is a light-emitting diode (LED) and the rigid shaft is a bored, threaded bolt enabling attachment of the sighting device to conventional sight holders secured to archery bows. In addition, the head of the bolt provides a unique and secure holding means for the light-emitting diode. Also, appropriate protection for the voltage-applying means, light source and the end of the rigid shaft at which the light source is mounted are provided.

In another form of the invention, the lighted sight pin without the final, rigid tube may be mounted in a conventional, magnifying, scope sight to provide a lighted, scope sighting device. In this version, the sight portion within the scope sight is invisible to the shooter except for the lighted end.

The lighted sight pin therefore provides a versatile sighting device useable by either target or hunting archers which is durable in use, is simple and compact in construction, and yet enables high accuracy in shooting.

These and other objects, advantages, purposes and features of the invention will become more apparent from a study of the following description taken in conjunction with the drawings.

DESCRIPTION OF THE PREFERRED EMBODIMENTS

Figure 1:
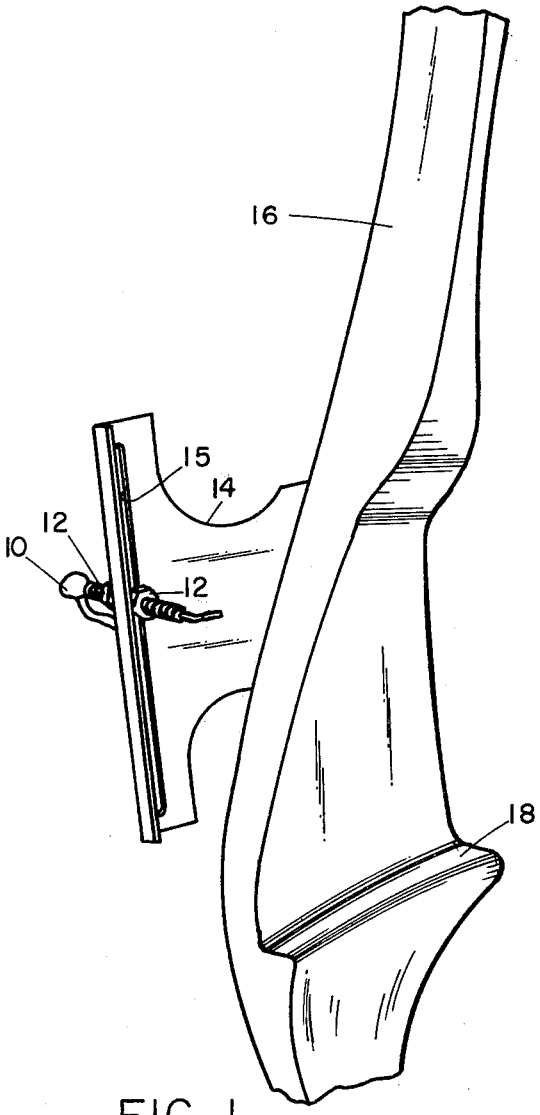
FIG. 1 is a fragmentary, perspective view of the sight area of a conventional archery bow illustrating one form of the present invention mounted theron.

Referring now to the drawings in greater detail, FIGS. 1-4 illustrate a first form 10 of the lighted sight pin invention. Sight pin 10 is secured by a pair of opposing bolts 12 to a slotted bracket or sight holder 14. Bracket 14 is secured to the shaft of a bow 16 immediately above the rest area 18 for arrow shafts which is used when shooting. The lighted sight pin 10 generally is an elongated, narrow, sighting device which is inserted through an elongated, vertically extending slot 15 in mounting bracket 14 with bolts 12 being tightened on the threaded, outer, circumference of the sight pin against opposing sides of the bracket to hold it in the desired location. Because of the elongated slot 15, the vertical position of the sight pin can be changed as desired in order to accommodate the personal preference of the archer.

Figure 3:
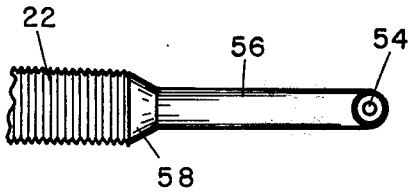
FIG. 3 is a fragmentary, side elevation of the sight end of the lighted sight pin shown in FIGS. 1 and 2.
Figure 4:
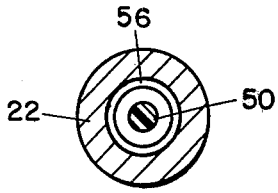
FIG. 4 is a sectional view of the lighted sight pin taken along plane IV—IV of FIG. 2.
Figure 2:
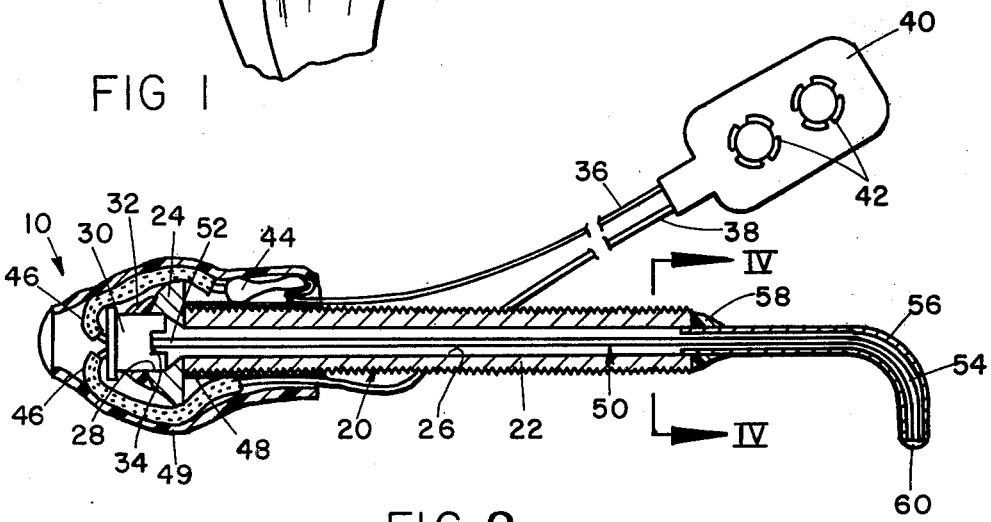
FIG. 2 is a sectional, side view of the form of the invention shown in FIG. 1.

Referring now to FIGS. 2-4, sight pin 10 includes an elongated bolt or screw 20 having a rigid, threaded shaft 22 and an integral, round or other shaped head 24 at one end. Bolt or screw 120 is formed from brass or another corrosive-resistant metal so as to be completely rigid and provide a protection for the internal portions of the sight pin while being resistive to weather conditions.

Bored centrally through the screw or bolt 20 is a passageway 26 which is cylindrical, extends along the axis of shaft portion 22, and widens into a light source receiving area 28 at the head end of shaft 22. Light source receiving area 28 of the passageway is coaxial with the remainder of passageway 26.

Received at least partially within receiving area 28 of passageway 26 is the light source for the pin 10 which, in the preferred embodiment, is a generally cylindrical, light-emitting diode (LED) 30. Diode 30 is secured within head 24 by a quantity of epoxy adhesive 32 which extends between the cylindrical sides of the diode and bolt head 24. The base end of the light-emitting diode 30 includes a cylindrical recess 34 which receives one end of the light-transmitting, fiber optic rod 50 as will be explained hereinafter.

In order to cause diode 30 to produce light, a source of voltage is connected to the diode including a pair of lead wires 36, 38 which extend from the end of the diode 30 which is opposite its base end including recess 34. Lead wires 36, 38 are connected to a conventional battery connector 40 having a pair of snap connections 42 on one side thereof which are in turn soldered or otherwise joined respectively to the lead wires. Connector 40 is disigned for mechanical, snap attachment to the terminals of a conventional, 9 volt, transistor-type, dry cell battery which provides a DC current and a voltage potential through the lead wires to the diode 30. In one of the lead wires 36, 38 is connected a resistor 44, preferably of approximately 510 ohms, which reduces the voltage applied to diode 30 to a level required by the diode, Typically about 2.8 volts. The ends of leads 36, 38 adjacent diode 30 and bolt head 24 include electrical insulation 46 thereover to prevent short circuits against the metallic bolt head 24 or other parts of the sighting device. In addition, a protective, flexible, resinous plastic, shrink tube 48 is applied and telescoped over the end of shaft 22 immediately adjacent the underside of bolt head 24 and heated and shrunk therearound to provide further protection against short circuiting of the electrical components and lead wires providing the voltage source. The entire end of the sighting device in which the light-emitting diode 30 is held in bolt head 24 is covered with a vinyl or resinous plastic or other flexible, resilient, water-proof cover 49 which holds the diode ends of the leads 36, 38 and resistor 44 against the screw 30 and shrink tubing 48 to prevent jarring or shock damage, disconnection of the various electrical components, and protection against weather inasmuch as the sighting device is designed for outdoor use.

Extending centrally within passageway 26 is the light-transmitting, fiber-optic rod or cable 50. One end 52 of cable 50 is received within recess 34 in the base end of diode 30. Rod 50 extends rectilinearly through the entire passageway 26 and beyond the end of the rigid shaft 22, a substantial distance. The free end 54 of rod or cable 50 is bent at a right angle or 90° to the axis of the remainder or major portion of the rod or cable which extends through passageway 26. Such a bend provides a small or point light source which can be positioned to face directly toward the eye of the archer as (FIG. 1) when sighting device 10 is mounted on a holding bracket 14 on a bow 16. Rod or cable 50 is preferably formed from a transparent, resilient but generally rigid, thermoplastic material. Preferably, cable or rod 50 has a cylindrical configuration and an outside diameter of approximately 0.025 inches. This cable may, but need not be, reflectively coated on its exterior and transmits light from the diode 30 through passageway 26 to the end 54 of the cable where it is visible to the human eye.

In order to fully protect the light-transmitting rod or cable 50, embodiment 10 of the lighted sight device includes a length of hollow, cylindrical, rigid tubing also formed from brass or another corrosive-resistant metal which is telescoped into passageway 26 at the free end of shaft 22. Rigid tube 56 typically has a diameter of 0.0625 inches and is press-fitted within the inside diameter of passageway 26 in rigid shaft 22. Tube 56 is secured in place and retained by soldering with silver solder which also provides a sealant and transition area 58 between the larger, outside diameter of shaft 22 and the smaller, outside diameter of rigid tube 56 (FIGS. 2 and 3). Solder 58 is therefore tapered between those two sized portions. The adhesive prevents entry of water, dirt and other contaminants within the passageway 26. Moreover, if desired, at the opposite end of tube 56 is a small, plastic transparent cap or quantity of adhesive or sealant 60 which seals the open, free end of tube 56 which is coterminous with the end 54 of fiber-optic rod or cable 50. The outer end of tube 56 is also bent to correspond to the bend in end 54 of rod 50 and therefore provides complete shielding protection for the cable enabling use of the sighting device in all types of weather conditions and on varying terrain where brush, trees, twigs and the like are encountered, all without damage to the sighting device. Further, since tube 56 is only slightly larger than the outside diameter of rod or cable 50 (FIG. 3), the overall area of the sight end of the device, which is used to sight and aim the bow, is extremely small, and provides what is equivalent to a small or point source of light allowing accurate aiming and shooting with the bow.

Preferably, light-emitting diode 30 emits a light with a wavelength or frequency in the red color range making the point of light at the sight end of tube 56 highly visible in dim light or at night. In addition, the exterior or rigid shaft 22 is threaded, typically with an 8–32 thread, enabling mounting of securing nuts such as those shown at 12 in FIG. 1 over the free end 60 of tube 56 and threading onto the exterior of shaft 22 to secure the sighting device in place as desired.

Once the lighted, sighting device or sight pin 10 is mounted in place as shown in FIG. 1, the pin is adjusted such that end 60 of tube 56, which includes end 54 of light-transmitting rod 50, is pointing rearwardly toward the archer and away from the target. Shaft 22 is sufficiently long to position end 60 for appropriate viewing with one eye by the archer immediately above and in alignment with the arrow shaft rest ledge 18 shown in FIG. 1. The archer need only snap a 9-volt, transistor radio battery to the connector 40 and tape the battery to a convenient portion of the bracket 14 or bow 16. The voltage applied to the doide 30 causes the diode to emit light which is transmitted by rod or cable 50 to end 60 of tube 56. There the small point of red or other light is highly visible by the archer and enables the pin to be visible in all light conditions for accurate aiming.

Figure 5:
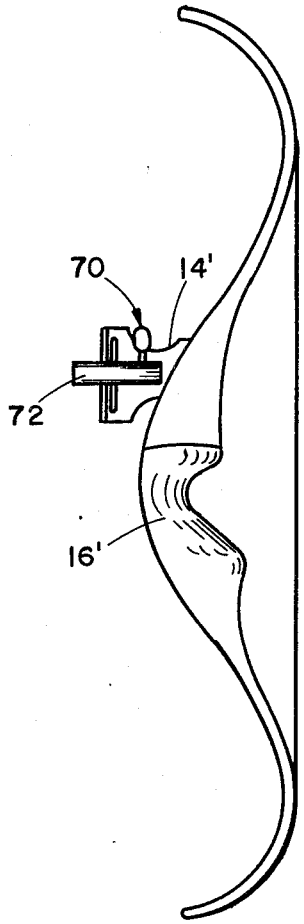
FIG. 5 is a side elevation of an archery bow with another form of the present invention mounted in a magnifying scope sight on the bow.
Figure 7:
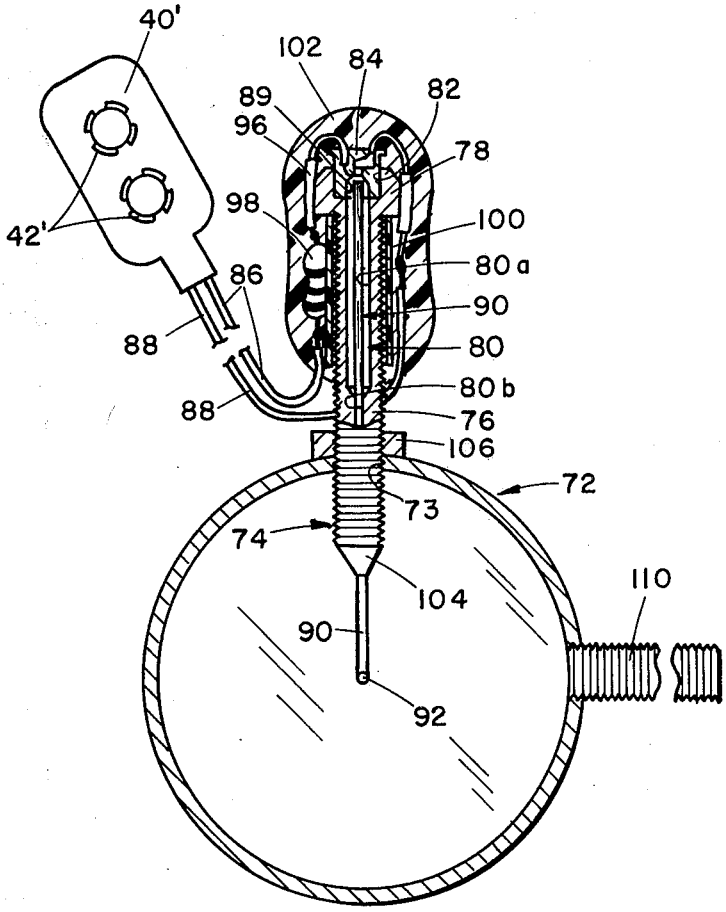
FIG. 7 is a sectional, end elevation of the magnifying scope sight of FIGS. 5 and 6 taken along line VII—VII of FIG. 6 with the lighted sight pin also shown in section.
Figure 6:
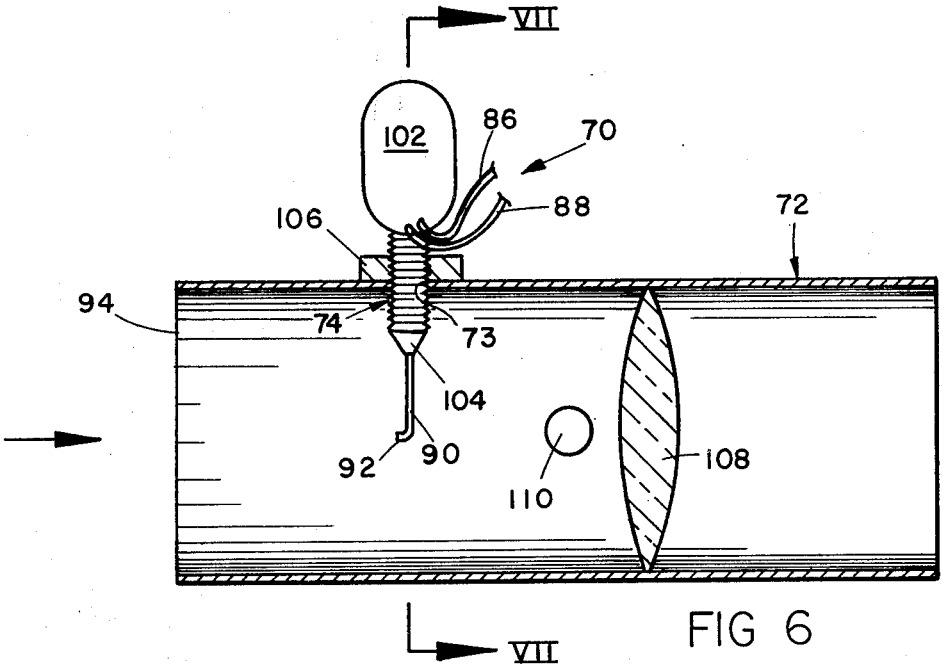
FIG. 6 is a sectional, side elevation of the magnifying scope sight shown in FIG. 5 including the second form of the lighted sight pin of the present invention.

Referring now to FIGS. 5–7, an alternate embodiment 70 of the lighted sight pin is illustrated together with a conventional magnifying scope sight commonly used by target shooting archers. As with embodiment 10 of the lighted sight pin, pin 70 is designed for use with a mounting bracket or holder 14' secured to one side of the bow 16' as shown in FIG. 5. However, with embodiment 70, magnifying scope sight 72 is secured to bracket 14' while sight pin 70 is secured to the top of scope sight 72 as shown in the drawing figures.

With some variation, embodiment 70 of the sight pin is generally similar to embodiment 10 as shown in FIG. 7. Sight pin 70 includes a rigid bolt or screw 74 having a shaft 76 and an integral head 78. Shaft 76 is also centrally bored along its axis to provide a passageway 80 through which the light-transmitting rod or cable 90 passes. However, passageway 80 includes a larger diameter portion **80*a* which extends from a large, coaxial recess 82 in screwhead 78 to a smaller diameter passageway portion 80*b* extending to the end of shaft 76. Passageway portion 80*b* is only slightly larger than the outside diameter of ight-transmitting rod or cable 90 and thus provides secure support for that rod or cable as shown best in FIG. 7**.

Within recess 82 in screwhead 78 is mounted a light-emitting diode 84 having a pair of voltage-applying lead wires 86, 88 extending therefrom. Doide 84 includes a recess 89 coaxial with bore **80*a* and 80*b* which receives one end of fiber-optic cable or rod 90. Rod 90 extends through passageways 80*a*, 80*b* and beyond the free end of shaft 76 a sufficient length to enable the end of the rod or cable to be positioned at the exact center of the cross-sectional area of the scope sight when mounted therein as shown in FIG. 7. Also, the end 92 of rod or cable 90 is bent at a right angle to the major length thereof which extends through passageways 80*a*, 80*b* so as to enable direction of the light emitted by the diode 84 and transmitted by rod or cable 90 directly at the eye of the archer who views the combined scope sight and lighted sight pin from end 94 of the scope sight. Since rod 90 is transparent, and very small in diameter, the portion of the rod which projects beyond shaft 76 and sealant 104 is invisible to the archer except for lighted end 92**. This greatly facilitates accuracy and prevents blockage of the view of the target.

As shown in FIG. 7, the ends of leads 86, 88 adjacent diode 84 are covered with electrical insulation 96 to protect the lead wires against frictional contact with the side marginal edges of bolthead or screwhead 78. In addition, a voltage dropping resistor 98 is secured in one of the lead wires to reduce the voltage from a 9-volt DC dry cell battery connected via snap connectors 42' on battery connector 40' in the same manner as described in connection with embodiment 10 of the lighted sight pin. Resistor 98 is preferably about 390 ohms providing a voltage of approximately 3.5 volts across diode 84. This provides a brighter light than with embodiment 10 because embodiment 70 is typically used for daylight, tournament shooting.

Lighted sight pin 70 includes plastic shrink tubing 100 telescoped over and secured around the upper end of shaft 76 immediately adjacent the underside of bolt head 78 to protect the lead wires and resistor from rubbing against the threaded exterior of the shaft. In addition, the entire lead end of screw or bolt 74 including diode 84, a portion of leads 86, 88, resistor 98, bolt head 78 and a portion of shaft 76 of the screw are encased by dipping the entire end of the lighted sight pin in a liquid plastic substance called "Plasti-Dip," manufactured by Plasti-Dip International of St. Paul, Minn. After the coating material sets up and dries, it forms a resilient, protective coating and casing for the light-emitting diode end of the device for secure protection against damage and the elements. In addition to the plastic casing 102, lighted sight pin 70 includes an epoxy adhesive 104 forming a tapered seal between the larger diameter end of screw 74 and the small diameter fiber-optic rod or cable 90 (FIGS. 6 and 7).

Lighted sight pin 70 is mounted in magnifying scope sight 72 through a threaded aperture 73 extending radially through the top of the scope sight tube. Sight pin 70 may be threaded downwardly through aperture 73 in the scope sight because the end 92 on fiber-optic rod or cable 90 does not project beyond the diameter of the shaft 76 at screw 74. A nut 106, which has been previously threaded on the exterior of shaft 76, is then tightened against the exterior of the tube or barrel of scope sight 72 to hold the sight pin in position (FIGS. 6 and 7). The proper position for end 92 of rod or cable 90 is such that it faces end 94 of the scope sight and extends along the central axis of the sight tube. The end of the cable, and thus the small point source of light transmitted by the cable from the diode 84, will be visible to the eye of the archer who is viewing in the direction of the arrow shown in FIG. 6. A battery is connected to connector 40' and taped either to bracket 14', scope sight 72, or bow 16' in a convenient position and the sight pin 70 is operational.

It will be noted that in combination with the scope sight, sight pin 70 is positioned ahead of a magnifying lens 108 which is secured downstream along the path of sight through the scope sight (FIG. 6). In addition, a rigid support arm or rod 110 is secured to the side of the scope sight 72 which enables mounting of the entire combination scope sight and lighted sight pin 70 on bracket 14' as shown in FIG. 5 and in the same manner in which the sight pin 10 is mounted on bracket 14 as described above in connection with FIGS. 1–4. It will be understood that although lighted sight pin 70 does not include a rigid tube over the final, free end 92 of rod 90 such as that shown at 56 in pin 10, the fiber-optic rod or cable 90 is completely protected from damage even if the scope sight is used in the woods or brush because of the surrounding protection of shaft 76 and the scope sight tube 72. In addition, lighted sight pin 70 is protected from the elements by the encasing cover 102, the tapered sealant 104 and the corrosive-resistant metallic material from which the screw or shaft 76 and head 78 are formed. It will be understood that embodiment 10 may also be used with a scope sight like 72 if desired.

Accordingly, the present invention provides a durable, highly useful, compact sight pin visible in all light conditions including dim light and at night. The light provided is a soft red, making it highly visible in such lighting conditions while the structure for providing the light is solid-state, protected and rigid making the device extremely durable. In addition, the particular combination of elements enables the sight to include a small point of light which is actually viewed when aiming the bow making this sighting device extremely accurate.

While several forms of the invention have been shown and described, other forms will now be apparent to those skilled in the art. Therefore, it will be understood that the embodiments shown in the drawings and described above are merely for illustrative purposes, and are not intended to limit the scope of the invention which is defined by the claims which follow.

The embodiments of the invention in which an exclusive property or privilege is claimed are defined as follows.

1. A lighted sight pin for use with archery bows comprising a rigid shaft; holding means at one end of said shaft for holding a light source; said shaft and holding means including a continuous passageway extending therethrough; a light source secured at one end of said passageway at least partially within said holding means; voltage applying means connected to said light source for applying an electrical voltage thereto; light-transmitting means extending from said light source, through said passageway and beyond the other end of said rigid shaft for transmitting light from said light source to the end of said light-transmitting means to provide a lighted sight at said end of said light-transmitting means; encapsulating means for covering and protecting said holding means, said light source and portions of said voltage-applying means and shaft; said light source being a light-emitting diode received in an enlarged portion of said passageway in said holding means; said light-emitting diode including a recess aligned with said passageway; said light-transmitting means having one end extending into said recess, a generally rectilinear portion, and an opposite end extending beyond the end of said rigid shaft, said opposite end extending at a right angle to said generally rectilinear portion.

2. The lighted sight pin of claim 1 including sealing means for sealing said other end of said rigid shaft around said light-transmitting means.

3. A lighted sight pin for use with archery bows comprising a rigid shaft; holding means at one end of said shaft for holding a light source; said shaft and holding means including a continuous passageway extending therethrough; a light source secured at one end of said passageway at least partially within aid holding means; voltage applying means connected to said light source for applying an electrical voltage thereto; light-transmitting means extending from said light source, through said passageway and beyond the other end of said rigid shaft for transmitting light from said light source to the end of said light-transmitting means to provide a lighted sight at said end of said light-transmitting means; encapsulating means for covering and protecting said holding means, said light source and portions of said voltage-applying means and shaft; a rigid tube secured in said passageway at said other end of said rigid shaft; said light-transmitting means extending through said tube to and being conterminous with the free end of said tube such that said light-transmitting means is protected along its entire length by said rigid shaft and tube.

4. The lighted sight pin of claims 2 or 3 wherein said light-transmitting means is a fiber-optic rod.

5. A lighted sight pin for use with archery bows comprising a rigid shaft; holding means at one end of said shaft for holding a light source; said shaft and holding means including a continuous passageway extending therethrough; a light source secured at one end of said passageway at least partially within said holding means; voltage applying means connected to said light source for applying an electrical voltage thereto; light-transmitting means extending from said light source, through said passageway and beyond the other end of said rigid shaft for transmitting light from said light source to the end of said light-transmitting means to provide a lighted sight at said end of said light-transmitting means; encapsulating means for covering and protecting said holding means, said light source and portions of said voltage-applying means and shaft; said rigid shaft being threaded on its exterior for securement to a sight-supporting member.

6. The lighted sight pin of claim 5 including a protective tube around said shaft adjacent said holding means to protect said voltage applying means therearound from abrasion.

7. The lighted sight pin of claim 6 wherein said encapsulating means include a settable, flowable, plastic material applied to said light source, holding means and over said protective tube and a portion of said rigid shaft and enclosing a portion of said voltage-applying means, said plastic material setting up as a protective covering when exposed to air for a period of time.

8. The lighted sight pin of claim 5 in combination with a rigid, magnifying, cylindrical sight tube for archery bows, said sight tube having a threaded aperture extending radially therethrough and receiving said threaded shaft of said lighted sight pin whereby said sight tube surrounds the exposed portion of said light-transmitting means extending beyond said one end of said shaft, the end of said exposed light-transmitting portion being bent and extending along the axis of said sight tube and toward one end of said sight tube.

9. A lighted sight pin for use with archery bows comprising a rigid bolt having an enlarged head at one end, an elongated shaft projecting along an axis from said head, and a bore coaxial with and extending through said shaft and head; a light-emitting diode secured in said bore in said bolt head; a rigid, hollow, protective tube secured in and extending from said bore opposite said bolt head and having a free end; a fiber-optic rod extending from said light-emitting diode, through said bore and said hollow tube, and being coterminous with said ree end of said tube, said fiber-optic rod being encased in said rigid bolt shaft and tube to prevent damage thereto; voltage-applying means for applying an electrical voltage to said light-emitting diode to cause said diode to emit light which is transmitted to the end of said protective tube by said fiber-optic rod; and cover means for covering said light-emitting diode, bolt head and portions of said bolt shaft and voltage-applying means.

10. The lighted sight pin of claim 9 wherein said hollow tube closely surrounds said fiber-optic rod such that the end of said rod and tube provides a small lighted sight end while being ridigly encased and protected.

11. The lighted sight pin of claim 10 wherein the end of said hollow tube at which said fiber-optic rod terminates includes a transparent sealing cover thereover.

12. The lighted sight pin of claim 9 wherein said light-emitting diode includes a recess aligned with said passageway; said fiber-optic rod having one end extending into said recess, a generally rectilinear portion, and an opposite end extending beyond the end of said rigid bolt shaft, said opposite end extending in said hollow tube and including a portion extending at a right angle to said generally rectilinear portion.

13. The lighted sight pin of claim 12 wherein said rigid bolt is threaded on its exterior for securement to a sight-supporting member.

14. The lighted sight pin of claim 9 wherein said voltage-applying means include a pair of wire leads connected to said light-emitting diode, connecting means for connecting said wire leads to a battery, and a voltage-dropping resistor connected to one of said leads between said connecting means and said light-emitting diode.

15. A light sight pin for use with archery bows comprising a rigid shaft; holding means at one end of said shaft for holding a light source; said shaft and holding means including a continuous passageway extending therethrough; a light source secured at one end of said passageway at least partially within said holding means; voltage applying means connected to said light source for applying an electrical voltage thereto; light-transmitting means extending from said light source, through said passageway and beyond the other end of said rigid shaft for transmitting light from said light source to the end of said light-transmitting means to provide a lighted sight at said end of said light-transmitting means; encapsulating means for covering and protecting said holding means, said light source and portions of said voltage-applying means and shaft; and a protective tube around said shaft adjacent said holding means to protect said voltage applying means therearound from abrasion.

16. The lighted sight pin of claim 15 wherein said encapsulating means include a settable, flowable, plastic material applied to said light source, holding means and over said protective tube and a portion of said rigid shaft and enclosing a portion of said voltage-applying means, said plastic material setting up as a protective covering when exposed to air for a period of time.

17. A lighted sight pin for use with archery bows comprising a rigid shaft; holding means at one end of said shaft for holding a light source; said shaft and holding means including a continuous passageway extending therethrough; a light source secured at one end of said passageway at least partially within said holding means; voltage applying means connected to said light source for applying an electrical voltage thereto; light-transmitting means extending from said light source, through said passageway and beyond the other end of said rigid shaft for transmitting light from said light source to the end of said light-transmitting means to provide a lighted sight at said end of said light-transmitting means; encapsulating means for covering and protecting said holding means, said light source and portions of said voltage-applying means and shaft; and a rigid, hollow member extending from said other end of said rigid shaft and having a cross-sectional area smaller than that of said rigid shaft; said light-transmitting means extending through said smaller, hollow member to the free end of said smaller, hollow member whereby said light-transmitting means is protected along its entire length by said rigid shaft and smaller, hollow member with said free end of said smaller, hollow member and the protected light-transmitting means providing a small, lighted sighting tip enabling proper aiming and accuracy while shooting using the sight pin.

18. The lighted sight pin of claim 17 wherein said light source is a light-emitting diode; said light-transmitting means including a fiber-optic rod.

* * * * *

UNITED STATES PATENT AND TRADEMARK OFFICE

CERTIFICATE OF CORRECTION

PATENT NO. : 4,177,572

DATED : December 11, 1979

INVENTOR(S) : Ted E. Hindes

It is certified that error appears in the above-identified patent and that said Letters Patent are hereby corrected as shown below:

Column 3, line 37:
"120" should be --20--.

Column 3, line 66:
"disigned" should be --designed--.

Column 5, line 55:
"ight-transmitting" should be --light-transmitting--.

Column 8, line 2, claim 3:
"aid" should be --said--.

Column 9, line 1, claim 9:
"ree" should be --free--.

Signed and Sealed this

*Tenth* Day of *June 1980*

[SEAL]

*Attest:*

SIDNEY A. DIAMOND

*Attesting Officer*

*Commissioner of Patents and Trademarks*